United States Patent [19]

McLuskie

[11] 4,204,443

[45] May 27, 1980

[54] CUTTING METHOD AND APPARATUS

[76] Inventor: Albert McLuskie, 6 Newland Ave., Harrogate, North Yorkshire, England

[21] Appl. No.: 880,369

[22] Filed: Feb. 23, 1978

[30] Foreign Application Priority Data

Mar. 4, 1977 [GB] United Kingdom ..... 9191/77
Mar. 4, 1977 [GB] United Kingdom ..... 9199/77

[51] Int. Cl.[2] ..... D06H 7/00

[52] U.S. Cl. ..... 83/37; 83/310; 83/331; 83/346; 83/913

[58] Field of Search ..... 83/913, 331, 322, 343, 83/37, 310, 346

[56] References Cited

U.S. PATENT DOCUMENTS

| | | | |
|---|---|---|---|
| 3,062,082 | 11/1962 | Keith | 83/913 X |
| 3,733,945 | 5/1973 | Cook | 83/913 X |
| 3,826,163 | 7/1974 | Spaller et al. | 83/913 X |
| 4,014,231 | 3/1977 | Hutzezon | 83/913 X |

*Primary Examiner*—J. M. Meister
*Attorney, Agent, or Firm*—Cushman, Darby & Cushman

[57] ABSTRACT

Apparatus and method for cutting continuous material wherein the material is wrapped around a drum and positively forwarded directly against cutter blades.

17 Claims, 6 Drawing Figures

CUTTING METHOD AND APPARATUS

This invention relates to cutting continuous lengths of material into shorter lengths, in particular though not exclusively to cutting synthetic filamentary material into staple fibre, and to apparatus and a method therefor.

The cutting of synthetic thermoplastic polymeric materials into staple fibres involves certain specific requirements, in particular the avoidance of heat build-up in cutting which might otherwise cause fibre fusion and accuracy of cutting to a specified length as well as the capability to cut different lengths of fibre. Many methods and forms of cutting have been proposed but only a few have been adopted on the commercial scale. In one such method, which has found great favour in cutting large tows of synthetic polymeric filaments, the filaments are continuously wrapped under tension about a large wheel carrying at its periphery a plurality of outward facing blades. The winding tension combined with the accumulation of wraps and the pressure applied by a roller acting on the filament wraps severs the filaments into lengths which pass inward between the blades and eventually drop from the wheel. While this method offered a large improvement over prior methods, particularly in respect of the useful life of the cutting blades, it fell short of the ideal in this respect and created new problems due mainly to the movement of the cut fibre against the operating centrifugal forces which tended to cause at least partial blockages of cut fibre within the cutting wheel. The latter problem had led to the proposal of several remedies such as the use of gas jets to free any accumulation of fibre or to a radical rearrangement of the geometry of the cutting blades in relation to fibre movement. None of these remedies has been ideal in all respects, particularly if comparatively small bundles of filaments are to be cut and if very high cutting rates are desired. In the prior apparatus in particular knife blade wear has still been significant due primarily to relative movement along or across the blade edge by the filaments during the actual cutting. The effect of such movement in dulling the blade is frequently accentuated by the presence of a pressure roll as part of the applied cutting force.

According to the present invention we provide a method of cutting continuous lengths of material into shorter lengths, comprising winding the material in turns about a drum and positively forwarding the wound material along the drum to impinge against cutting blades projecting radially therefrom and spaced around the drum periphery.

Also according to this invention we provide apparatus for cutting continuous lengths of material into shorter lengths, comprising a rotatable drum for receiving turns of material having a plurality of spaced cutting blades affixed thereto and radially projecting therefrom, means to positively forward material wound on the drum to impinge against the blades and means to rotate the drum.

Unlike the prior art apparatus for cutting heavy tows of filaments which can not deal with filamentary yarns, monofilaments or other relatively light weight feed materials and can not be scaled down to deal with such materials, the cutting apparatus of this invention is specifically adapted to the cutting of such small diameter materials. The apparatus may be made quite small and capable of operating at very high speeds and in this way is particularly well adapted to cut continuous synthetic filaments at a rate equal to their production speed in, for example a melt spinning/drawing process, such speeds being up to ten or more times those possible with known filament cutting apparatus. In addition the drum onto which the material to be cut is wound may be and is preferably, driven from one end. The material can then be forwarded towards the other end and cut by the radially projecting blades which are preferably mounted at or very close to the extremity of the drum. In this manner one end of the drum, where preferably the fibre is cut is left entirely free and unencumbered and this makes it a simple matter to incorporate a cutter of the invention into an in-line process for the direct production of synthetic staple fibre. This construction also makes it possible to collect the cut fibre in an orderly fashion and to treat or form it in some further way since there is no physical impediment to the placing of apparatus for this purpose close to the cutter.

In a cutting method according to this invention only a small number of wraps of uncut material are provided on the cutter drum and these are supplied and wound thereon at only a small tension. The wraps of material are controlled substantially right up to the instant of cutting and are forwarded to the cutting edges without any riding up or overlapping of the wraps. For these reasons difficulties encountered in prior art cutters due to out of balance forces arising from uneven wrapping or cutting or the deliberate compacting of wraps one upon the other are obviated and prolonged high speed operation is facilitated. The force required to forward the wraps to the cutting blades and to effect cutting is small and thus not only are soft materials, such as polytetrafluoroethylene and polyethylene, easily and uniformly cut but a proportionally lower power consumption is required.

As indicated above it is preferred to attach the radially projecting cutter blades at or very close to the free end of the drum. In order that centrifugal or aerodynamic effects tending to cause wrapped uncut material to move away from the drum surface and along the blade edges should be minimised it is preferred to provide an annular ring at the outer ends of the blades forming a shallow channel, of a width appropriate to the diameter of the uncut material, between this ring and the drum surface to briefly retain the uncut material at the blade edges just prior to cutting and to prevent any tendancy for one wrap to override another at this point. Rings to suit different sizes of uncut material are easily fitted to the apparatus. In this way uncut material is constrained to move directly towards the blades and any tendancy to depart from such movement is substantially prevented.

Cutting by a method and apparatus according to this invention compared with prior methods and apparatus leads to a further improvement in blade life before sharpening or replacement is required due primarily to the facts that no pressure roll is used to provide the cutting force, very little wrapping tension is required and cutting is effected by direct contact of the material against the cutting blade without movement of the material along the edge before severance. Material to be cut is preferably applied to the cutter drum with the drum in motion thus facilitating use of the cutter as part of a continuous in-line process. Such use and operation of the cutter generally is greatly facilitated because the outlet for the cut fibre passing through the blades is unimpeded and centrifugal forces have full play to release the cut fibre instead of acting in opposition to fibre movement as in prior art cutters. Operation may be continued at high speeds for protracted periods substantially without blockage due to accumulation of fibre.

Known means for cutting, for example synthetic filaments, into very short lengths referred to as flock fibres, are deficient in that a bundle of filaments is taken and held while a cutting blade chops at the protruding end of the bundle. Much heat is produced unless the operation is conducted at a slow speed and uneven cutting frequently results, particularly of thermoplastic synthetic filaments which not only are fusible but are highly abrasive due to the presence of particles of opacifier. It is a particular feature of the present invention that synthetic thermoplastic filaments may be cut into flock fibres at high speed without any fusing and with a very high degree of uniformity of cut length even at lengths of one millimeter or less. The cut material may be directly dispersed in an air stream for passage to the flocking process.

Material wound on the cutter drum may be positively forwarded to impinge against the blades by various means. One preferred means is a small pressure roll the axis of rotation of which is not parallel to that of the drum, which bears against at least some of the wraps of the material on the drum and by reason of the skew drum/roll axes provides the required positive forwarding action. The forwarding roll is freely rotatable and is preferably not driven but merely caused to turn by contact with the material on the rotated drum. The material of the roll surface should have suitable frictional properties and preferably also some resilience to provide the required forwarding action without damage to the material to be cut. A hard rubber surface is a suitable material for this roll surface. Another such forwarding means is a cam so shaped as to provide together with the drum surface and the array of blades a channel which narrows towards the blades in the direction of travel of material wound on the drum. In this way uncut material led onto the drum surface in the channel so formed is progressively moved along the drum surface towards the knife blades by the narrowing of the channel ie by the approach of the cam surface to the knife blades. At its peak the cam approaches the blades very closely so as to bring the wound material into sufficient contact with the blades for cutting to be effected. The cam is independent of the drum and it may be either held stationary or allowed to slide freely around the drum (axial movement being restricted or prevented) and to turn with it at a self adjusting speed. It is preferred that the cam is held stationary with respect to the drum as this simplifies the apparatus. It is also preferred to provide that the cam is easily changed so that a cam can be selected to provide a forwarding channel of a size appropriate for the size of material being cut. The cam may partially or completely encircle the drum, the latter being preferred. The cam may also be shaped so as to provide more than one peak or point of closest approach to the knife blades. In this case more than one channel will be formed and thus more than one end of material to be cut may be led to the drum. It is preferred that the cam is so shaped as to provide a steady and light forwarding force on the uncut material and only a small increment at the actual point of cutting.

The method and apparatus of the invention are illustrated and further explained with reference to the accompanying drawings wherein.

Like numerals refer to like parts in these drawings and for convenience only a few of the plurality of blades are shown.

Figure 1:
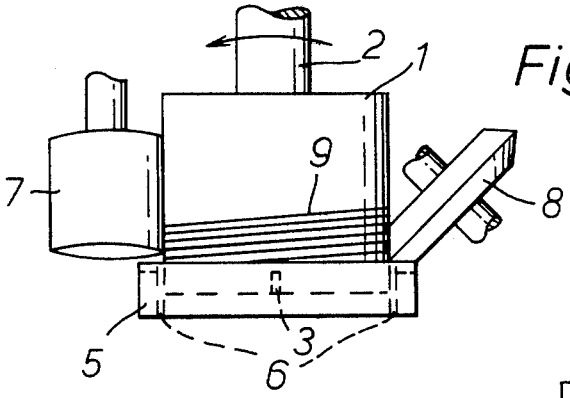
FIG. 1 is a plan view of one arrangement of the cutter.
Figure 2:
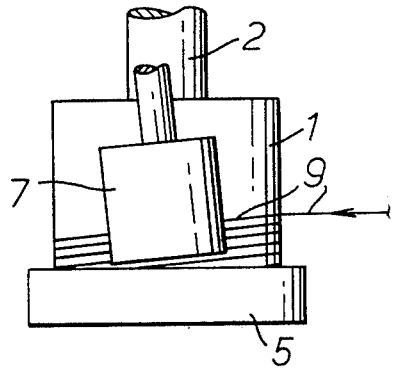
FIG. 2 is a side elevation of the apparatus viewed from the left hand side of FIG. 1.
Figure 3:
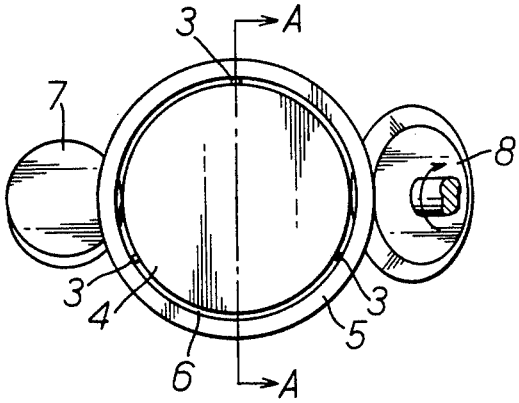
FIG. 3 is the apparatus of FIG. 1 viewed from the exit end of the drum.
Figure 4:
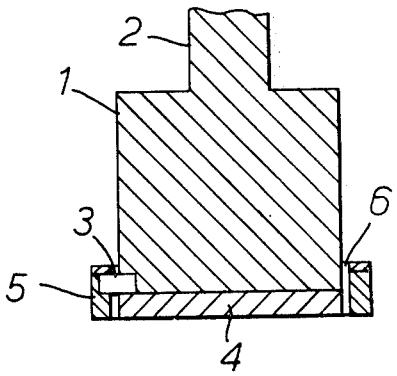
FIG. 4 is a sectional view taken on the plane A—A[1] of FIG. 3.

Referring to FIGS. 1–4 of the drawings a cutter comprises a drum 1, mounted on a shaft 2 to which drive means (not shown) is coupled, carries at its free end a plurality of blades 3 radially projecting at right angles from the drum surface and with the cutting edges oriented in the direction of the drive shaft 2. The blades 3 are held in place in slots in the drum 1 by means of a retaining disc 4. A ring 5 is affixed to the outer ends of blades 3 and provides shallow annular channels 6 on the blade edge and exit sides of the blades. A freely rotatable roll 7, the axis of which is skewed slightly (see FIG. 2) with respect to the axis of drum 1, is arranged to contact a portion of the periphery of drum 1. Optionally a second freely rotatable roll 8 may be arranged and shaped so as to uniformly contact a segment of the surfaces of drum 1 immediately before the blades 3.

In operation a length or several lengths of material 9 to be cut are supplied by feed means (not shown) to the surface of drum 1 at some distance from the blades (at least a sufficient distance for 1–3 wraps of the material) and wound therearound. The wind-on point is selected so that roll 7 contacts at least some of the wraps of material. As drum 1 is rotated roll 7 by contact with the material is also caused to rotate and provide a force acting along the drum surface in the direction of the blades 3 thus positively forwarding the wraps, which remain as unitary windings in side-by-side contact only, to impinge against the blades 3 being severed thereby into lengths corresponding accurately to the circumferential spacing of the blades 3.

Figure 5:
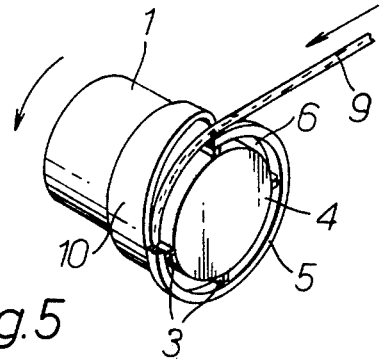
FIG. 5 is a general view of another arrangement of the cutter.
Figure 6:
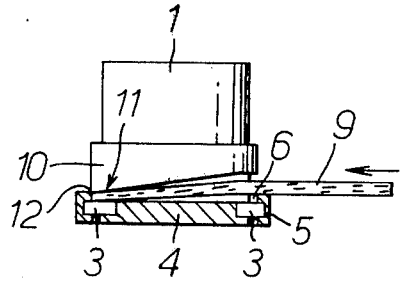
FIG. 6 is a plan view of the cutter of FIG. 5 partly sectioned.

Referring now to FIGS. 5 and 6 of the drawings a drum 1 attached to driving means at one end (not shown) carries at its other end a plurality of cutting blades 3 radially projecting at right angles from the drum surface and with their cutting edges oriented back along the drum surface. Blades 3 are held in place in slots in the drum 1 by means of a retaining disc 4. A ring 5 is affixed to the outer ends of the blades 3 providing shallow annular channels 6 on the cutting edge and the exit sides of the blade array. A cam 10 formed as a circular ring and so shaped as to form a channel 11 narrowing to a point 12 close to the blades 3 encircles drum 1. Cam 10 is either maintained stationary (i.e. no rotation or axial movement) by means not shown or is allowed to slide freely around drum 1 as it is rotated.

In operation a length of material 9 to be cut is supplied by feed means (not shown) to the channel 11 and led around the drum 1 until cutting commences by progression of the wraps of material in the channel 7 along the drum 1 and against the blades 3 at the point of closest approach 12. Since the cam 10 is either stationary or freely sliding on drum 1 the point 12 sweeps across the whole blade array thus causing lengths of material to be cut progressively corresponding to the blade spacing. The cut lengths pass between the blades 3 through the annular channel 6 and are thrown clear by centrifugal and gravitational forces.

Because drum 1 may be made of quite small diameter (of the order of 100 mm) and the blades very short (of the order of 16 mm) there is no significant difference in the distance between a pair of blades at the root and the tip and thus a high accuracy of cut length may be readily obtained. Additionally since the blades are very short and small overall, unusual materials such as tungsten carbide and diamond may be used as the blade materials with the concomitant benefits of such materials. If the second roll is used in the embodiment of FIGS. 1–4 forwarding of a uniform layer of wrapped material to the blades may be further ensured.

In the foregoing embodiments the blades 3 are arranged with the sides of the blades in planes parallel to the longitudinal or rotational axis of drum 1. Alteration of cut lengths or more particularly the cutting of a mixture of lengths may be effected by mounting some of the blades in planes at a small angle to this plane thus varying the circumferential distance between successive cutting edges.

In a modified embodiment of a cutter according to this invention a common forwarding roll 7 of larger diameter may be used to provide the forwarding forces to material wound on a plurality of smaller drums 1 arranged about and in contact with the common forwarding roll, each being fitted with cutter blades and other parts of the apparatus as necessary.

The cutting apparatus may also be used to treat the uncut material prior to cutting. For example by heating the drum 1 the material may be given a heat treatment before cutting. Likewise in an embodiment according to FIG. 1 by forming drum 1 with a taper of increasing diameter towards the blades and supplying the material to be cut to the drum at a controlled speed some drawing or stretching of the uncut material may be effected. Similarly if the material is positively fed to the drum and there is applied a difference in speed between the drum surface and the feed speed again drawing or stretching may be effected before cutting.

Very high cutting speeds, measured as the linear feed speed of uncut material supplied to the cutter, may be achieved, as for example a speed of several thousand meters per minute. The apparatus being of comparatively small diameter may be made of robust material capable of withstanding high rotational forces. The main limitations as to cutting speed are the aerodynamic effects of the lightly tensioned material wound on the drum. These are influenced by the tension, the extent of contact with the forwarding means and secondary roll if present, the linear weight of the material and perhaps other factors and it is not possible to set down an actual value for the upper limit of speed. However, for a multifilamentary synthetic polyamide yarn of 1100 decitex and drum and forwarding roll diameters of 100 mm and 50 mm respectively continuous operation at 3,000 m/min for protracted periods is easily achieved or for a multifilamentary polyamide yarn of 20,000 decitex cutting speeds, in the FIG. 5 embodiment (100 mm diam drum 1), of 1,400 m/min or more maybe employed for prolonged periods. In the latter case it is preferred to maintain only 1–2 wraps on drum 1.

I claim:

1. A method of cutting continuous lengths of material into shorter lengths comprising winding the material in turns about a cylindrical surface of a drum and while substantially preventing the turns from overriding one another positively forwarding the wound material in an axial direction along the drum to impinge against cutting blades projecting radially therefrom and spaced around the drum periphery, said blades having radially extending cutting edges.

2. A method according to claim 1 wherein the cutting blades are located at or near one end of the drum.

3. A method according to claim 1 wherein the material is forwarded by a freely rotatable pressure roll, the axis of which is skewed relative to the axis of the drum, and which contacts at least some of the turns of uncut material on the drum.

4. A method according to claim 3 wherein a second freely rotatable roll contacts the wound material immediately before impingement on the blades.

5. A method according to claim 3 wherein a single skewed roll forwards the material wound on two or more drums.

6. A method according to claim 1 wherein the material is forwarded by a cam, encircling but independent of the drum, and shaped to provide together with the drum surface and the array of blades a channel which narrows towards the blades in the direction of travel of uncut material into which channel the material to be cut is wound.

7. A method according to claim 6 wherein the cam is held stationary relative to the drum.

8. A method according to claim 1 wherein the material to be cut comprises synthetic thermoplastic filaments.

9. A process according to claim 1 wherein the total decitex of filaments to be cut is up to 20,000.

10. A process according to claim 1 wherein the filaments are cut into flock fibres.

11. Apparatus for cutting continuous lengths of material into shorter lengths, comprising a rotatable drum having a cylindrical surface for receiving turns of material, said drum having a plurality of circumferentially spaced cutting blades affixed thereto and radially projecting therefrom, said blades having radially extending cutting edges, means to positively forward material wound on the drum in an axial direction toward the blades so as to impinge against the blades while preventing overriding of the material on the drum, and means to rotate the drum.

12. Apparatus according to claim 11 wherein the cutting blades are located at or near one end of the drum.

13. Apparatus according to claim 11 wherein the forwarding means is a freely rotatable pressure roll, the axis of which is skewed relative to the axis of the drum, and which contacts at least some of the turns of uncut material on the drum.

14. A method of cutting continuous lengths of filaments into shorter lengths comprising: helically winding the filaments in turns about a cylindrical surface of a rotating drum having a plurality of cutting blades projecting therefrom at or near one end thereof and spaced around the periphery thereof, each blade having a cutting edge which extends radially and faces axially toward the wound filaments; substantially preventing the turns from overriding one another on the cylindrical surface of the drum; and positively forwarding the wound filaments axially along the cylindrical surface to impinge against the cutting edges of the blades.

15. A method as in claim 14 wherein the filaments pass through an annular channel formed between the drum and a ring which is fixed to and surrounds the blades.

16. Apparatus for cutting continuous lengths of filaments into shorter lengths comprising: a rotatable drum having cylindrical surface; a plurality of cutting blades projecting from said cylindrical surface at or near one end of said drum, and spaced around the periphery of said drum, each blade having a cutting edge extending radially of said drum and facing axially toward said cylindrical surface; means for positively axially forwarding filaments wound helically on said cylindrical surface, while preventing the turns from overriding one another, toward said blades so as to impinge against said radially extending cutting edges.

17. Apparatus as in claim 15 including a ring fixed to and surrounding said blades, said ring forming with said drum an annular channel in which said blades are located.

* * * * *